US006899520B2

(12) United States Patent
Habedank et al.

(10) Patent No.: US 6,899,520 B2
(45) Date of Patent: May 31, 2005

(54) METHODS AND APPARATUS TO REDUCE SEAL RUBBING WITHIN GAS TURBINE ENGINES

(75) Inventors: Mark Steven Habedank, Hamilton, OH (US); Daniel Edward Wines, Cincinnati, OH (US); Christopher James League, Cincinnati, OH (US); Aaron Michael Dziech, Cincinnati, OH (US); George Edwin Whitaker, Sharonville, OH (US)

(73) Assignee: General Electric Company, Schenectady, NY (US)

( * ) Notice: Subject to any disclaimer, the term of this patent is extended or adjusted under 35 U.S.C. 154(b) by 7 days.

(21) Appl. No.: 10/653,337

(22) Filed: Sep. 2, 2003

(65) Prior Publication Data

US 2005/0047910 A1 Mar. 3, 2005

(51) Int. Cl.[7] ..... F01D 11/02

(52) U.S. Cl. ..... 415/174.5; 415/199.5; 415/230

(58) Field of Search ..... 415/173.7, 174.5, 415/199.5, 230

(56) References Cited

U.S. PATENT DOCUMENTS

| | | | | |
|---|---|---|---|---|
| 4,088,422 | A | 5/1978 | Martin | |
| 4,659,289 | A * | 4/1987 | Kalogeros | 416/198 A |
| 5,131,814 | A | 7/1992 | Przytulski et al. | |
| 5,197,281 | A | 3/1993 | Przytulski et al. | |
| 5,236,302 | A | 8/1993 | Weisgerber et al. | |
| 5,275,534 | A | 1/1994 | Cameron et al. | |
| 5,288,210 | A | 2/1994 | Albrecht et al. | |
| 5,318,405 | A | 6/1994 | Meade et al. | |
| 5,338,154 | A * | 8/1994 | Meade et al. | 415/173.7 |
| 5,352,087 | A * | 10/1994 | Antonellis | 415/115 |
| 5,749,701 | A | 5/1998 | Clarke et al. | |
| 6,139,264 | A | 10/2000 | Schilling | |
| 6,283,712 | B1 * | 9/2001 | Dziech et al. | 416/179 |
| 6,398,488 | B1 | 6/2002 | Solda et al. | |
| 6,464,453 | B2 | 10/2002 | Toborg et al. | |

* cited by examiner

*Primary Examiner*—Ninh H. Nguyen
(74) *Attorney, Agent, or Firm*—Armstrong Teasdale LLP; William Scott Andes

(57) ABSTRACT

A method facilitates assembling a seal assembly for a gas turbine engine rotor assembly. The method comprises coupling a disk retainer to a first stage disk, and coupling an interstage seal assembly including an outer shell within the rotor assembly such that a downstream arm extending from the outer shell engages a second stage disk while an upstream arm extending from the outer shell engages the disk retainer.

16 Claims, 2 Drawing Sheets

METHODS AND APPARATUS TO REDUCE SEAL RUBBING WITHIN GAS TURBINE ENGINES

BACKGROUND OF THE INVENTION

This invention relates generally to gas turbine engines, and more specifically to seal assemblies used with gas turbine engine rotor assemblies.

At least some known gas turbine engines include a core engine having, in serial flow arrangement, a fan assembly and a high pressure compressor which compress airflow entering the engine, a combustor ignites a fuel-air mixture which is then channeled towards low and high pressure turbines which each include a plurality of rotor blades that extract rotational energy from airflow exiting the combustor. The high pressure compressor is coupled by a shaft to the high pressure turbine.

At least some known high pressure turbines include a first stage disk and a second stage disk that is coupled to the first stage disk by a bolted connection. More specifically, the rotor shaft extends between a last stage of the multi-staged compressor and the web portions of the turbine first stage disk. The first and second stage turbine disks are isolated by a forward faceplate that is coupled to a forward face of the first stage disk, and an aft seal that is coupled to a rearward face of the second stage disk web. An interstage seal assembly extends between the first and second stage disks to facilitate sealing flow around a second stage turbine nozzle.

At least some known interstage seal assemblies include an interstage seal and a separate blade retainer. The interstage seal is coupled to the first and second stage disks with a plurality of bolts. The blade retainer includes a split ring that is coupled to an axisymmetric hook assembly extending from the turbine stage disk. However, because the seal assemblies are complex, such interstage seal assemblies may be difficult to assemble. To facilitate reducing the assembly time and costs of such seal assemblies, other known interstage seal assemblies include an integrally-formed interstage seal and blade retainer. More specifically, such seal assemblies use radial and axial interference to transmit torque from the stage two disk to the stage one disk. However, because such seal assemblies are coupled between the turbine stage disks with radial and axial interference fits, such seal assemblies may be susceptible to low cycle fatigue (LCF) stresses induced from one or both turbine stage disks.

BRIEF SUMMARY OF THE INVENTION

In one aspect a method for assembling a seal assembly for a gas turbine engine rotor assembly is provided. The method comprises coupling a disk retainer to a first stage disk, and coupling an interstage seal assembly including an outer shell within the rotor assembly such that a downstream arm extending from the outer shell engages a second stage disk while an upstream arm extending from the outer shell engages the disk retainer.

In another aspect, a seal assembly for a gas turbine engine including a first stage disk and a second stage disk is provided. The seal assembly comprises a disk retainer and an interstage seal assembly that extends between the first and second stage disks. The interstage seal assembly comprises a radially outer shell extending radially outward from a web portion. The outer shell comprises an upstream arm and a downstream arm that each extend outwardly from the outer shell. The disk retainer is positioned between the outer shell upstream arm and the first stage disk. The downstream arm is coupled to the second stage disk.

In a further aspect, a gas turbine engine comprises a rotor assembly comprising a first stage disk, a second stage disk, and a seal assembly extending therebetween. The seal assembly comprises a disk retainer and an interstage seal assembly. The interstage seal assembly comprises a radially outer shell and a web portion. The outer shell extends radially outward from the web portion and comprises an upstream arm and a downstream arm. The disk retainer is coupled between the outer shell upstream arm and the first stage disk. The downstream arm is coupled to the second stage disk.

DETAILED DESCRIPTION OF THE INVENTION

Figure 1:
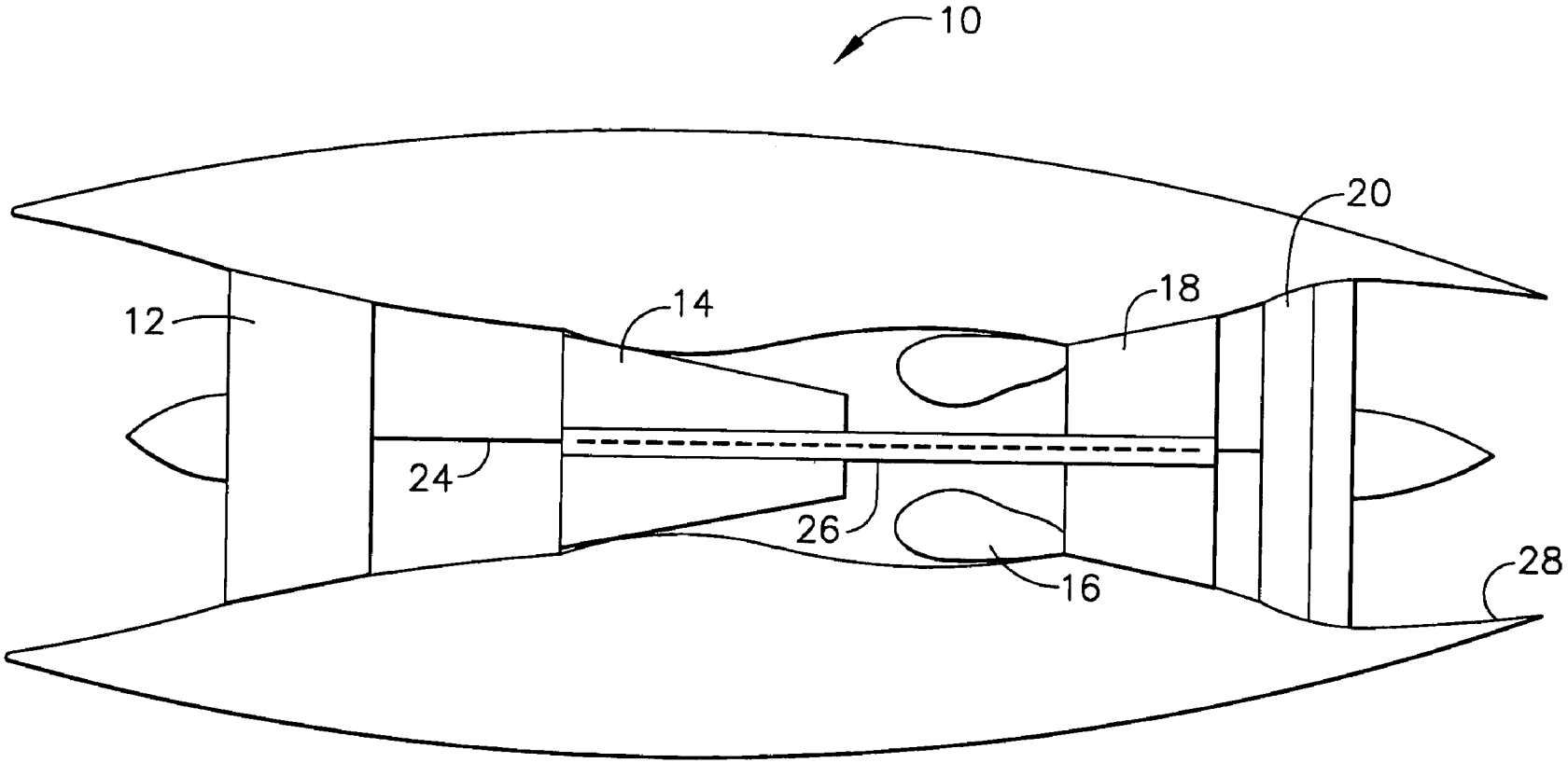
FIG. 1 is a schematic illustration of a gas turbine engine.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20. Compressor 12 and turbine 20 are coupled by a first shaft 24, and compressor 14 and turbine 18 are coupled by a second shaft 26. In one embodiment, the gas turbine engine is a GE90 available from General Electric Company, Cincinnati, Ohio.

In operation, air flows through low pressure compressor 12 and compressed air is supplied from low pressure compressor 12 to high pressure compressor 14. The highly compressed air is delivered to combustor 16. Airflow from combustor 16 drives turbines 18 and 20 before exiting gas turbine engine 10.

Figure 2:
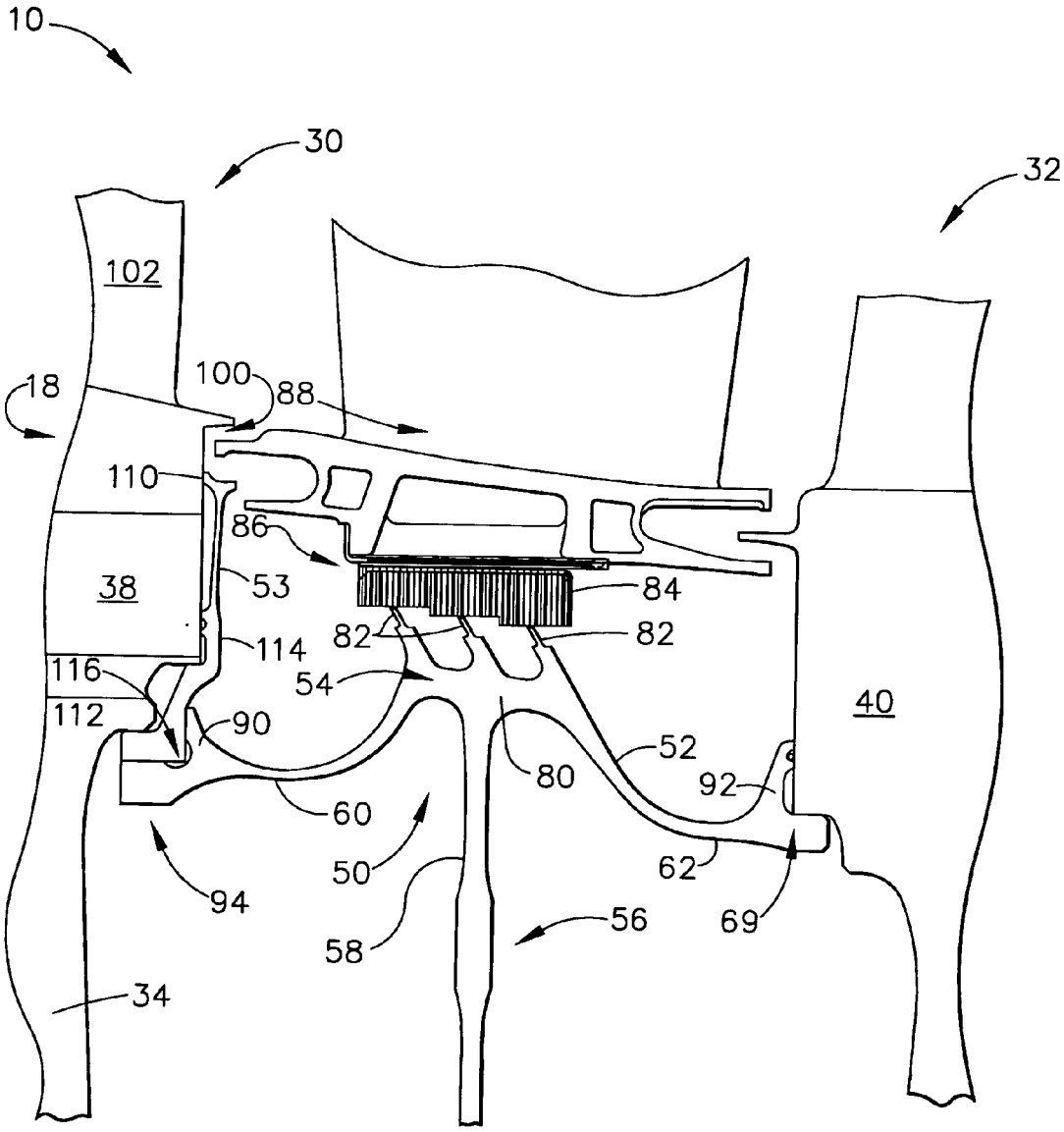
FIG. 2 is an enlarged partial cross-sectional view of a portion of the gas turbine engine shown in FIG. 1.

FIG. 2 is an enlarged partial cross-sectional view of a portion of gas turbine engine 10. Specifically, FIG. 2 illustrates an enlarged partial cross-sectional view of high pressure turbine 18. High pressure turbine 18 includes first and second stage disks 30 and 32, respectively. Each stage disk 30 and 32 includes a respective web portion 34 and 36 that extends radially outward from a bore (not shown) to a respective blade dovetail slot 38 and 40.

An interstage seal assembly 50 extends axially between turbine stage disks 30 and 32. More specifically, seal assembly 50 includes an interstage seal member 52 and a disk or blade retainer 53. Interstage seal member 52 includes an outer shell 54 and a central disk 56 which has a web portion 58 and a bore (not shown). Shell 54 is generally cylindrical and includes an upstream or forward arm 60 and a downstream or aft arm 62.

Each arm 60 and 62 is arcuate and extends in an axial direction with an inwardly convex shape. More specifically, each arm 60 and 62 extends with a catenary curve from a mid portion 80 of outer shell 54 to each respective disk 30 and 32. Mid portion 80 includes a plurality of seal teeth 82 which contact a seal member 84 coupled to a radially inner side 86 of a second stage nozzle assembly 88.

A flange 90 and 92 is formed integrally at an upstream and downstream end 94 and 96, respectively, of each arm 60 and 62. Flanges 90 and 92 enable interstage seal member 52 to couple between first and second stage disks 30 and 32, respectively. More specifically, aft flange 92 enables interstage seal arm 62 to couple to second stage disk 32 with an interference fit, rather than with the use of any fasteners. In addition, as described in more detail below, forward flange 90 enables interstage seal arm 60 to couple to first stage disk 30 with an interference fit, rather than with the use of any fasteners.

Disk retainer 53 extends along a downstream side 100 of first stage disk dovetail slot 38 to facilitate retaining first stage rotor blades 102 within dovetail slot 38. More specifically, retainer 53 has a radially outer end 110, a radially inner end 112, and a body 114 extending therebetween. Radially inner end 112 extends generally perpendicularly upstream from body 114 such that an elbow 116 is formed between body 114 and end 112. Elbow 116 facilitates maintaining disk retainer 53 in a proper position relative to first stage disk 30, and also facilitates coupling disk retainer 53 to interstage seal member 52 in a boltless connection.

Disk retainer 53 is coupled to first stage disk 30 with a radial interference fit. Specifically, disk retainer 53 is retained in position relative to first stage disk 30 and to interstage seal assembly 50 by interstage seal member 60, such that disk retainer elbow 116 is received within interstage seal arm flange 90. More specifically, as interstage seal assembly 50 is coupled to disk retainer 53, as described below, interstage seal assembly 50 orients disk retainer 53 such that retainer 53 is substantially centered with respect to first stage disk 30. Moreover, the radial interference fit between disk retainer 53 and interstage seal member 52 facilitates centering seal member 52 with respect to turbine 18.

During assembly, initially blade retainer 53 is inserted in position within rotor assembly 18 such that blade retainer 53 engages first stage disk 30. Interstage seal member 52 is then axially squeezed or compressed and coupled within rotor assembly 18 such that interstage seal member arm 60 is coupled against blade retainer 53 in a radial interference fit, and such that seal member arm 62 is coupled against second stage disk 32 in an interference fit. Accordingly, when assembled, because seal member 52 is in compression, seal member 52, and more specifically, the catenary curvature of arms 60 and 62, causes an axial load to be induced to blade retainer 53. The axial loading facilitates maintaining blade retainer 53 in position relative to first stage disk 30 and interstage seal assembly 50. Moreover, the radial interference fit between blade retainer 53 and first stage disk 30, and the radial interference fit between blade retainer 53 and interstage seal member 52 facilitate centering blade retainer 53 with respect to first stage disk 30 and with respect to interstage seal assembly 50.

The above-described interstage seal assemblies are cost-effective and highly reliable. The interstage seal assembly includes an interstage seal member and a separate disk retainer. The disk retainer is maintained in an interference fit with the first stage disk by the interstage seal member. The interstage seal member is coupled to both the disk retainer and the rotor assembly by interference fits. Accordingly, assembly times are facilitated to be reduced, as no fasteners are needed to couple the interstage seal assembly within the rotor assembly. Moreover, the interference fit between the interstage seal member and the disk retainer facilitates increasing the low cycle fatigue life of the interstage seal assembly, while enabling the differential torque generated between the turbine stage disks to be frictionally transferred through the interstage seal assembly. As a result, the interstage seal assembly facilitates extending a useful life of the turbine rotor assembly in a cost-effective and reliable manner.

Exemplary embodiments of rotor assemblies are described above in detail. The rotor assemblies are not limited to the specific embodiments described herein, but rather, components of each assembly may be utilized independently and separately from other components described herein. For example, each interstage seal assembly component can also be used in combination with other interstage seal assembly components and with other rotor assemblies.

While the invention has been described in terms of various specific embodiments, those skilled in the art will recognize that the invention can be practiced with modification within the spirit and scope of the claims.

What is claimed is:

1. A method for assembling a seal assembly for a gas turbine engine rotor assembly, said method comprising:

coupling a disk retainer to a first stage disk; and coupling an interstage seal assembly including an outer shell within the rotor assembly such that a downstream arm extending from the outer shell engages a second stage disk while an upstream arm extending from the outer shell engages the disk retainer in an interference fit.

2. A method in accordance with claim 1 wherein coupling an interstage seal assembly including an outer shell within the rotor assembly further comprises coupling the interstage seal assembly between the first and second stage disks such that the interstage seal assembly is in compression.

3. A method in accordance with claim 1 wherein coupling an interstage seal assembly including an outer shell within the rotor assembly further comprises:

coupling the disk retainer to the first stage disk with an interference fit such that the disk retainer is between the first stage disk and the interstage seal assembly.

4. A method in accordance with claim 1 wherein coupling an interstage seal assembly including an outer shell within the rotor assembly further comprises coupling the interstage seal assembly upstream arm to the disk retainer such that the interstage seal assembly facilitates orienting the disk retainer with respect to the seal assembly.

5. A seal assembly for a gas turbine engine including a first stage disk and a second stage disk, said seal assembly comprising:

a disk retainer; and an interstage seal assembly extending between the first and second stage disks, said interstage seal assembly comprising a radially outer shell extending radially outward from a web portion, said outer shell comprising an upstream arm and a downstream arm extending outwardly from said outer shell, said disk retainer coupled between said outer shell upstream arm and the first stage disk, said downstream arm coupled to said second stage disk wherein said upstream arm is coupled to said disk retainer with an interference fit and said downstream arm is coupled to the second stage disk with an interference fit.

6. A seal assembly in accordance with claim 5 wherein said disk retainer is secured in position by axial loading induced from said interstage seal assembly.

7. A seal assembly in accordance with claim 5 wherein said upstream and downstream arms each extend arcuately in a catenary contour from said outer shell.

8. A seal assembly in accordance with claim 7 wherein said outer shell is in compression when said seal assembly is coupled between the first and second stage disks.

9. A seal assembly in accordance with claim 5 wherein said seal assembly facilitates extending a useful life of turbine.

10. A seal assembly in accordance with claim 5 wherein said interstage seal facilitates aligning said disk retainer with respect to the first stage disk.

11. A gas turbine engine comprising a rotor assembly comprising a first stage disk, a second stage disk, and a seal assembly extending therebetween, said seal assembly comprising a disk retainer and an interstage seal assembly, wherein said seal assembly disk retainer is coupled between said first stage disk and said interstate seal, said interstage seal assembly comprising a radially outer shell and a web portion, said outer shell extending radially outward from said web portion and comprising an upstream arm and a downstream arm, said disk retainer coupled between said outer shell upstream arm and said first stage disk, said downstream arm coupled to said second stage disk, wherein said interstate seal assembly upstream arm is coupled to said disk retainer by an interference fit and said downstream arm is coupled to said second stage disk by an interference fit.

12. A gas turbine engine in accordance with claim 11 wherein said seal assembly disk retainer is secured in position by axial loading induced from said interstage seal.

13. A gas turbine engine in accordance with claim 11 wherein at least one of said interstage seal assembly upstream and downstream arms extends arcuately in a catenary contour from said outer shell.

14. A gas turbine engine in accordance with claim 11 wherein said interstage seal is in compression when coupled between said first and second stage disks.

15. A gas turbine engine in accordance with claim 11 wherein said interstage seal facilitates extending a useful life of said gas turbine engine.

16. A gas turbine engine in accordance with claim 11 wherein said interstage seal facilitates orienting said disk retainer with respect to said seal assembly.

* * * * *

UNITED STATES PATENT AND TRADEMARK OFFICE

CERTIFICATE OF CORRECTION

PATENT NO. : 6,899,520 B2
APPLICATION NO. : 10/653337
DATED : May 31, 2005
INVENTOR(S) : Habedank et al.

It is certified that error appears in the above-identified patent and that said Letters Patent is hereby corrected as shown below:

In Claim 11, column 5, line 9, delete “interstate” and insert therefor -- interstage --.
In Claim 11, column 5, line 16, delete “interstate” and insert therefor -- interstage --.

Signed and Sealed this

Sixth Day of November, 2007

JON W. DUDAS
*Director of the United States Patent and Trademark Office*